US005619093A

United States Patent [19]

Glesener et al.

[11] Patent Number: 5,619,093

[45] Date of Patent: Apr. 8, 1997

[54] ELECTRON FIELD EMISSION

[75] Inventors: John W. Glesener, Crofton; Arthur A. Morrish, LaPlata, both of Md.

[73] Assignee: The United States of America as represented by the Secretary of the Navy, Washington, D.C.

[21] Appl. No.: 414,838

[22] Filed: Mar. 31, 1995

[51] Int. Cl.[6] ..... H01J 1/14

[52] U.S. Cl. ..... 313/309; 313/336; 313/351

[58] Field of Search ..... 313/309, 336, 313/351, 445; 445/50

[56] References Cited

U.S. PATENT DOCUMENTS

| | | | |
|---|---|---|---|
| 4,084,942 | 4/1978 | Villalobos | 313/336 |
| 4,164,680 | 8/1979 | Villalobos | 313/336 |
| 5,258,685 | 11/1993 | Jaskie et al. | 313/336 |
| 5,290,610 | 3/1994 | Kane et al. | 427/577 |
| 5,430,348 | 7/1995 | Kane et al. | 313/309 |

*Primary Examiner*—Sandra L. O'Shea
*Assistant Examiner*—Vip Patel
*Attorney, Agent, or Firm*—Thomas E. McDonnell; George Kap

[57] ABSTRACT

In a system containing an electron field emitter array characterized by applying diamond powder to a substrate and affixing the powder thereto, the diamond powder being composed of particles having sharp tips which are adapted to emit electrons in a vacuum and in an electric field, which electrons impact a phosphor layer disposed on an anode spaced above the tips of the diamond powder particles.

13 Claims, 1 Drawing Sheet

ELECTRON FIELD EMISSION

This invention generally relates to cold cathode field emission.

FIELD OF INVENTION

Although the current world market for flat panel displays is dominated by liquid crystal displays, this may change with the advent of field emission displays. Field emission displays can use an array of cold cathodes as a source of electrons to impinge on an anode applied to a phosphor-coated substrate.

Traditional cold cathodes either use high electric fields produced by sharp tips or a cesium-treated semiconductor surface as a high current source of electrons. The problem with these types of cathodes is that they require ultra high vacuum conditions, pose difficulties in fabrication and tend to degrade with time.

Diamond, because of its negative electron affinity and chemical and mechanical properties, has been proposed as an alternative to metals as a cold cathode material.

Preliminary reports in the technical literature indicate that diamond cold cathodes can operate at pressures of about $10^{-6}$ torr or less without any degradation in emission current over time. The literature reports also reflect that current designs for diamond cold cathodes fall within the categories of polycrystalline boron-doped diamond films grown on silicon substrates and boron-doped diamond films fabricated with pyramidal-shaped or cone-shaped tips to enhance field emission of electrons.

U.S. Pat. No. 5,341,063 to Kumar discloses a field emitter with diamond emission tips. The Kumar field emitter comprises a conductive metal and diamond emission tips in ohmic contact with and protruding above the metal. The Kumar emitter is fabricated by coating a substrate with an insulating diamond film having a top surface with spikes and valleys, depositing a conductive metal on the film, etching the metal to expose the spikes, and annealing the emitter to provide ohmic contact between the diamond film and the metal. The Kumar patent discloses that in the diamond literature, tip radii as small as 100 nanometers have been reported.

SUMMARY OF INVENTION

An object of this invention is to reduce cost of fabricating a diamond field emitter array.

Another object of this invention is a field emitter array which is fabricated at a temperature that is not damaging to components of such an array.

Another object of this invention is to make a field emitter array from diamond powder using a simple process.

These and other objects of this invention are attained by an electron field emitter composed of a substrate and diamond powder particles secured to the substrate. The emitter is fabricated by depositing a diamond powder on a substrate and affixing the diamond powder particles to the substrate.

DETAILED DESCRIPTION OF INVENTION

Figure 1:
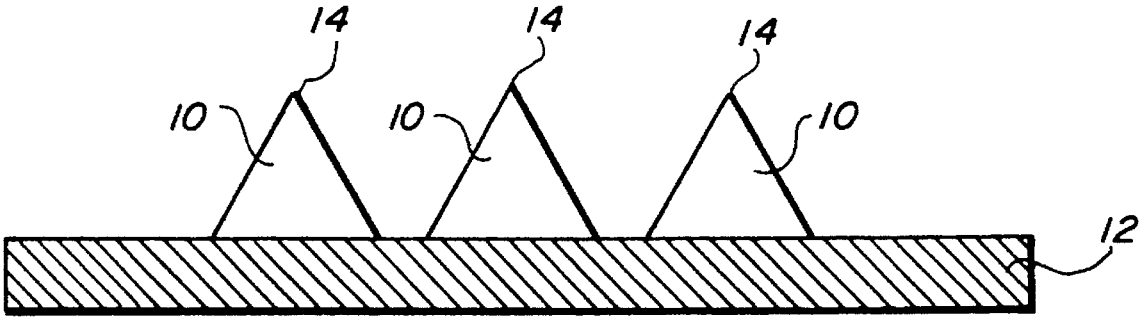
FIG. 1 is a schematic illustration of an electronic device of a substrate having disposed thereon jagged powder particles.

Fabrication of the diamond field emitter array of this invention involves depositing diamond powder 10 on a substrate 12. The powder is affixed to the substrate so that particles of the diamond powder are physically attached to the substrate and are not separated therefrom when the emitter is mechanically jolted or turned over. The powder can be ion implanted before or after the powder particles are secured to the substrate to modify the conductivity of electrons. The fabrication product is an electron diamond powder field emitter array wherein the cathodes are tips 14 of the diamond powder particles. Under the influence of an applied electric field, these tips emit electrons which pass through vacuum and impinge on a phosphor screen disposed above the powder. The impingement of the electrons on the phosphor screen illuminates the phosphors. It is estimated that the field emitter of this invention can have on the order of 10,000 diamond tips/cm$^2$. The distance between the tips is less than 1 micron.

A substrate is selected depending on requirements, application, availability, and possibly other factors. For purposes herein, a substrate serves as a support surface for the diamond powder particles that are deposited thereon and conducts electrons when an electric field is applied thereto. The substrate can be a metal or a semiconducting material. The substrate must conduct electrons at least to the extent of a semiconductor. A substrate can be of an insulating material initially in which case, it is ion implanted to render it electron conducting or coated with another material to enhance conductivity of electrons from a biasing source and through the powder particles. It is believed that electron emission appears to be enhanced by rendering the substrate more conductive to electrons. Specific materials suitable for a substrate include silicon, gallium arsenide, tungsten, tantalum, titanium and molybdenum. Dimensions of a typical substrate are on the order of four square millimeters in surface area with a thickness on the order of one-half millimeter, although the dimensions can vary widely to meet requirements of a particular application. Typically, thickness of a substrate is 1 to 500 microns, more typically 10 to 300 microns, although substrates of other thicknesses can be used.

The top surface to which the diamond particles are affixed is preferably flat. Typically, deviation of the top surface of a substrate from flat for purposes herein, will not be greater than the average diameter of the diamond particles deposited on the substrate.

The powder particles deposited on the top surface of the substrate should be deposited uniformly to form one layer of the particles on the substrate. The uniform deposition of the particles on a substrate ensures a uniform discharge of electrons from the particles. The electrons energize the pixels on the phosphor screen disposed directly above which is picked up and transmitted by a receiver and delivered to an eye.

Suitable diamond powder can come from natural or synthetic diamonds. Suitable powder particle size varies from about 10 nanometers to about 10 microns with an average particle size or diameter of less than about 1000 nanometers, although powders with lower or higher particle sizes are suitable. One typical natural diamond powder suitable herein has particle size varying from about 500 nanometers down to about 50 nanometers with an average particle diameter of about 150 nanometers. In this class of powders, 95% of the powder particles have diameters of less than about 0.30 micron or 300 nanometers and 10% of the powder particles have diameters of less than about 0.70 micron or 700 nanometers. Presently, commercially available diamond powders typically provide tips having a tip apex radius of about 50 nanometers or less. It is believed that the sharper the powder particle tips, the easier it is for electrons to escape.

The diamond powder, in unconsolidated or non-agglomerated form with discrete particles, can be applied to a substrate at room temperature in any conceivable manner that results in physical attachment of the powder particles to the substrate. It is necessary that attachment of a diamond powder particle establish an electrical contact between the diamond particle and the substrate. The powder particles can be attached to the substrate by the use of an appropriate bonding agent or by scratching the powder particles against the substrate in order to embed the particles in the substrate. The attachment of the particle to the substrate should be such that the particle is not dislodged when the substrate is jolted or turned on its side.

Commercially available diamond powder with an appropriate particle size can be used herein. Finer diamond powder may become readily available in the future, and should provide even better results in terms of facility of electron escape from the powder particle tips. The powder used for purposes herein can be ion-implanted to provide electrical conductivity therethrough and to enhance electron tunneling through the tips of the powder particles.

One way to attach the diamond powder particles to the substrate is to provide ohmic contact therebetween. Ohmic contact between the particles and a metal substrate can be provided by annealing the field emitter consisting of the substrate with the particles thereon heated to an elevated temperature. The ohmic contact so formed appears to be a thin layer of a carbide of diamond and the substrate metal.

The diamond powder disposed on a substrate can be ion implanted in a conventional manner with a dopant that can enhance electrical conductivity. Ion implantation of diamond powder is typically done before the annealing step. If a diamond powder which has been previously ion implanted is used, ion implantation of such a powder may be dispensed with.

In operation, a field emitter consists of a metal substrate with diamond powder particles on its top planar surface uniformly distributed and affixed thereto. The emitter is disposed horizontally and an anode is disposed thereover, spaced from the emitter but in close, parallel proximity thereto. The anode is typically a metal coating disposed on a glass plate with a phosphor layer interposed therebetween, with a thin metal coating facing the emitter. A voltage imposed between the anode and the emitter, which functions as the cathode, facilitates conduction of electrons through the substrate and through the tips of the diamond powder particles. As the electrons tunnel through the tips of the diamond particles under the influence of an electrical field, they are emitted from the tips and travel through a substantial vacuum towards the anode. Although the diamond powder disposed on a substrate is not an orderly array in the sense of prior art field emitters characterized by CVD deposited diamond films, the electrons emitted by the field emitter of this invention impinge on the phosphor coating and energize the pixels thereon. The image of the energized pixels is shown visually.

For a field emitter of this invention to emit electrons, a minimum voltage of about 5 volts per micron of gap width between the cathode and anode is typically used. This minimum voltage can also depend on parameters such as particle size of the diamond powder, material of the substrate, material of the anode, gap between the anode and cathode, and other parameters. A maximum voltage of about 50 volts per micron of the gap separation can be tolerated. If less than about 10 volts per micron is impressed, the electrons may lack sufficient energy to tunnel through the tip and then travel through the vacuum to the anode. If, however, the impressed voltage of about 50 volts per micron is exceeded, then arching would be expected. Typically, however, the biasing voltage will be in the approximate range of 10 to 50 volts per micron of the gap width.

EXAMPLE

This example demonstrates the use of a natural diamond powder field emitter.

The field emitter of this example was made by embedding diamond powder in a flat rectangular piece of molybdenum which functioned as a substrate. The powder was commercially obtained from Norton Materials of Saint-Gobain Industrial Ceramics. The powder had a particle distribution in the range of 0.5 to 0.05 micron with an average particle diameter of 0.15 micron or 150 nanometers. Average tip radius of the tip apex was about 20 nanometers. The molybdenum substrate was a rectangular sheet of molybdenum measuring 1 centimeter by 1 centimeter with a constant thickness of about 0.2 millimeters.

The powder was affixed to the substrate by means of a Q-tip applicator by rubbing or scratching the powder until the powder particles adhered to the substrate. The operation with the applicator was conducted over a period of about 3 minutes and resulted in a diamond powder field emitter with about 10,000 tips or peaks per square centimeter of the substrate.

To test the efficacy of the field emitter, it was placed in a vacuum of $10^{-8}$ torr. A tantalum probe in the form of a wire with a diameter of 0.25 millimeter was disposed thereover with a gap between the probe and the emitter of 250 microns, and a voltage of about 3,000 volts was impressed between the substrate and the probe. The biasing of the assembly was accomplished by electrically connecting the probe, which functioned as the anode, to the substrate, which functioned as part of the cathode, by way of an electrical source which supplied the 3,000 volts. The diamond tips of the powder particles functioned as the cathode. This assembly produced a current of $10^{-5}$ amperes (10 microamperes) between the anode and the cathode. Normalizing the fields and current densities, the current of $10^{-5}$ amperes compared favorably with what was reported in the technical literature as being adequate for a field emitter.

An identical molybdenum substrate, but devoid of the diamond powder, demonstrated no field emission when placed in the identical assembly described above.

Many modifications and variations of the present invention are possible in light of the above teachings. It is, therefore, to be understood that within the scope of the appended claims, the invention may be practiced otherwise than as specifically disclosed.

What is claimed is:

1. An electron emitting device comprising a substrate and diamond powder disposed on and affixed to said substrate, said diamond powder is composed of particles having tips which are adapted to emit electrons in response to an electrical force, wherein said device has about 10,000 tips/$cm^2$ of said diamond powder disposed on said substrate and an average tip radius at apex thereof is less than 1 micron, and wherein particle size distribution of said diamond powder is from about 10 nanometers to about 10 microns and average particle size of the powder is less than 1000 nanometers.

2. The electron emitting device of claim 1 wherein particle size of said diamond powder varies from about 50 nanometers to about 500 nanometers.

3. The electron emitting device of claim 2 wherein said diamond powder particles are in ohmic contact with said substrate and said substrate is electrically conducting.

4. The electron emitting device of claim 3 wherein said substrate is selected from the group consisting of titanium, platinum, molybdenum, tungsten, tantalum, silicon, gallium arsenide and mixtures thereof; thickness of said substrate is from less than about 1 micron to about 500 microns.

5. The electron emitting device of claim 3 wherein said substrate is metallic and the thickness thereof is in the approximate range of 10–300 microns.

6. A field emitter system comprising a substrate; diamond powder disposed on and affixed to said substrate; an anode disposed over and spaced above said diamond powder; a vacuum existing between said diamond powder disposed on said substrate and said anode; and a voltage differential between said powder and said anode of sufficient magnitude to emit electrons from said powder; wherein said diamond powder is composed of particles having tips which emit electrons in response to the voltage differential, said diamond powder has particle distribution from about 10 nanometers to about 10 microns; and wherein average particle size of said diamond powder is about 150 nanometers and tip radius at its apex is 50 nanometers or less; said system further includes a phosphor layer disposed above said anode so that said electrons impact said phosphor layer after being emitted by said tips.

7. The field emitter system of claim 6 wherein said field emitter system has on the order of 10,000 tips/cm$^2$ of said diamond powder disposed on said substrate and said voltage differential is in the approximate range of 5 to 50 volts per micron of gap between said tips and said anode.

8. The field emitter system of claim 7 wherein said substrate is electrically conducting; thickness of said substrate is in the approximate range of 10–300 microns; 95% of said diamond particle diameters are less than about 0.3 micron; and vacuum between said diamond powder and said phosphor layer is about $10^{-6}$ torr or less.

9. The field emitter system of claim 8 including an ohmic contact between said diamond powder particles and said substrate.

10. An electron emitting device comprising a substrate and a diamond powder disposed on and affixed to said substrate, said diamond powder is composed of particles having tips which are adapted to emit electrons in response to an electrical force, said device has on the order of 10,000 tips/cm$^2$ of said diamond powder disposed on said substrate with an average tip radius at apex thereof of less than 1 micron.

11. The device of claim 10 wherein said particles are distributed in one layer on said substrate.

12. The device of claim 11 wherein said substrate is flat with a deviation of not greater than the average diameter of said diamond particles.

13. The device of claim 12 wherein particle size distribution of said diamond powder is in the approximate range of 10 nanometers to 10 microns and it is ion-implanted to provide electrical conductivity therethrough and to enhance electron tunneling through said tips.

* * * * *